US009469952B2

(12) United States Patent
Quinn et al.

(10) Patent No.: US 9,469,952 B2
(45) Date of Patent: Oct. 18, 2016

(54) SNOW FLIPPER

(71) Applicants: Reed Quinn, Orem, UT (US); David B. Brough, Las Vegas, NV (US)

(72) Inventors: Reed Quinn, Orem, UT (US); David B. Brough, Las Vegas, NV (US)

( * ) Notice: Subject to any disclaimer, the term of this patent is extended or adjusted under 35 U.S.C. 154(b) by 0 days.

(21) Appl. No.: 14/828,341

(22) Filed: Aug. 17, 2015

(65) Prior Publication Data

US 2016/0047097 A1 Feb. 18, 2016

Related U.S. Application Data

(60) Provisional application No. 62/038,162, filed on Aug. 15, 2014.

(51) Int. Cl.
*E01H 5/02* (2006.01)

(52) U.S. Cl.
CPC ..... *E01H 5/02* (2013.01)

(58) Field of Classification Search
CPC ..... E01H 5/02; E02F 1/00; E04D 13/106; B25G 1/04
USPC ..... 294/49, 54.5, 60, 176, 181; 37/264, 37/265, 271, 283, 285
See application file for complete search history.

(56) References Cited

U.S. PATENT DOCUMENTS 2,769,612 A * 11/1956 Weisheit ..... E01H 5/02 254/131.5
2,846,785 A * 8/1958 Underwood ..... E02F 3/02 294/54.5
3,343,807 A * 9/1967 Moraski ..... A01B 1/028 254/131
3,748,761 A * 7/1973 Chetwynde ..... E01H 5/02 280/47.26
5,511,327 A * 4/1996 Jurkowski ..... E01H 5/02 294/54.5
6,203,081 B1 * 3/2001 Kegan, Sr. ..... A01B 1/028 254/131.5
7,305,779 B1 * 12/2007 Purvis ..... E01H 5/02 294/54.5
8,001,707 B2 * 8/2011 Coles ..... E01H 5/02 294/54.5
8,240,069 B2 * 8/2012 Adinata ..... A61K 48/00 37/285
2005/0160632 A1 * 7/2005 Williams ..... E01H 5/02 37/265
2009/0235559 A1 * 9/2009 Coles ..... E01H 5/02 37/270

* cited by examiner

*Primary Examiner* — Paul T Chin
(74) *Attorney, Agent, or Firm* — Superior IP, PLLC; Dustin L. Call

(57) ABSTRACT

A snow flipper for clearing snow. The snow flipper includes a blade. The snow flipper also includes a handle attached the blade. The handle includes a first portion, a second portion attached to the second portion and a bend creating a vertical portion of the handle. The snow flipper further includes a handgrip. The handgrip is movably secured to the handle, telescopes relative to the handle and provides a gripping surface for the user. The snow flipper additionally includes a flat spring attached to the vertical portion of the handle. The flat spring includes a curved piece of rigid material configured to deform under a force, return to its initial shape upon removal of the force and cause downward motion of the handgrip to result in motion that is upward and away from the user. The snow flipper moreover includes a wheel attached near one end of the flat spring.

1 Claim, 3 Drawing Sheets

SNOW FLIPPER

CROSS-REFERENCE TO RELATED APPLICATIONS

This application claims the benefit of and priority to U.S. Provisional Patent Application Ser. No. 62/038,162 filed on Aug. 15, 2014, which application is incorporated herein by reference in its entirety.

BACKGROUND OF THE INVENTION

Shoveling material, and in particular, shoveling snow, presents inherent challenges and risks; however when applied to a shoveler lacking in musculature or coordination or afflicted with difficulties associated with bending, pushing, lifting, twisting and throwing, shoveling is particularly difficult. Moreover, for those manifested with cardiac or respiratory problems, shoveling can be deadly. The shoveling act is exacerbated by several factors and conditions, including slippery or uneven surfaces, wet or sticky snow, or snow hard-packed from a vehicle passing over it, wind and/or cold weather, restrictive, bulky, and heavy clothing. Finally, because exercise is generally reduced during winter periods, the shoveler is often not in good physical condition, all of the aforementioned adding up to what many health professionals describe as a prescription for disaster.

Scientific research has determined that the conventional to-the-side shoveling process is as little as 3% efficient, making shoveling one of the least-efficient of all manual chores. Moreover, research has determined that after even a few minutes of shoveling a shoveler's heart rate and blood pressure approximate running to exhaustion on a treadmill. There is then little wonder that snow shoveling is directly implicated in thousands of cardiac deaths each year, and injuries, primarily to the lower back region but to other parts of the body, representing billions of dollars in lost productivity and health care costs.

Issues in shoveling snow include relocating the significant accumulation of snow blocking a driveway by a municipal plow truck; overcoming high banks of snow that can reach heights and depths of several meters; and dealing with material sticking to the digging panel, this not only increasing the weight of the load, but demanding that the user exert additional effort in cleaning said material from the panel surface, all of which makes for a frustrating experience that lengthens the shoveling process. Further, dealing with deep accumulations of snowfall which make conventional pushing or throwing techniques impractical or ill advised. Moreover, dealing with ice or snow hard-packed from a vehicle driving over it often results in the user improperly using the implement as a chipper resulting in damage to or destruction of the implement.

While mechanized snow blowers appear to present a solution to many shoveling dilemmas, they in themselves present problems. They are expensive to purchase, they are noisy and polluting, and are dangerous if not used properly. Aside from the initial purchase cost, continuing expenses includes fuel and maintenance. Moreover, there is an inherent difficulty at starting infrequently used engines, and unlike a shovel which can be hung up and easily stored, the snow blower requires significant dedicated storage space. There are also situations, such as stairs, decks, and other locations, and hard-packed snow, or ice, where the snow blower is unable to access, thus still requiring the employment of a shovel, broom, ice chipper, or other manual implement. Injuries from clearing debris is common. For regions that receive minimal snow or where the area to be cleared is relatively small or where storage is unavailable, a snow blower may simply be too expensive or impractical. Perhaps most importantly, manipulating a heavy snow blower requires significant exertion, and notwithstanding that these implements infer a significant reduction in physical exertion, at-risk persons who would not engage in activities requiring exertion are encouraged to use mechanical blowers such that each season snow blowers are implicated in numerous cardiac fatalities.

Accordingly, there is a need in the art for a single implement with the capability to undertake all shoveling chores. Moreover, there is a need in the art for an implement that reduces the significant stress shoveling places upon a shoveler's body, in particular stress associated with the bending, lifting, twisting, and throwing movements. Further, there is a need in the art for the implement be simple to operate, competitively priced, inexpensively shipped, and easily stored. In addition, there is a need in the art for an implement that transforms shoveling into healthy exercise. Moreover, there is a need in the art for the implement to be usable by handicapped individuals.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a snow flipper for clearing snow. The snow flipper includes a blade. The blade includes a leading edge configured to push under snow, a curved portion configured to scoop the snow and sides configured to prevent movement of the snow laterally relative to the blade. The snow flipper also includes a handle attached the blade. The handle includes a first portion, a second portion attached to the second portion and a bend creating a vertical portion of the handle. The snow flipper further includes a handgrip. The handgrip is movably secured to the handle, telescopes relative to the handle and provides a gripping surface for the user. The snow flipper additionally includes a flat spring attached to the vertical portion of the handle. The flat spring includes a curved piece of rigid material configured to deform under a force, return to its initial shape upon removal of the force and cause downward motion of the handgrip to result in motion that is upward and away from the user. The snow flipper moreover includes a wheel attached near one end of the flat spring. The wheel is made of rubber. The wheel is configured to support the end of the flat spring away from the underlying surface and support at least a portion of the weight of the snow flipper and any snow on the blade.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
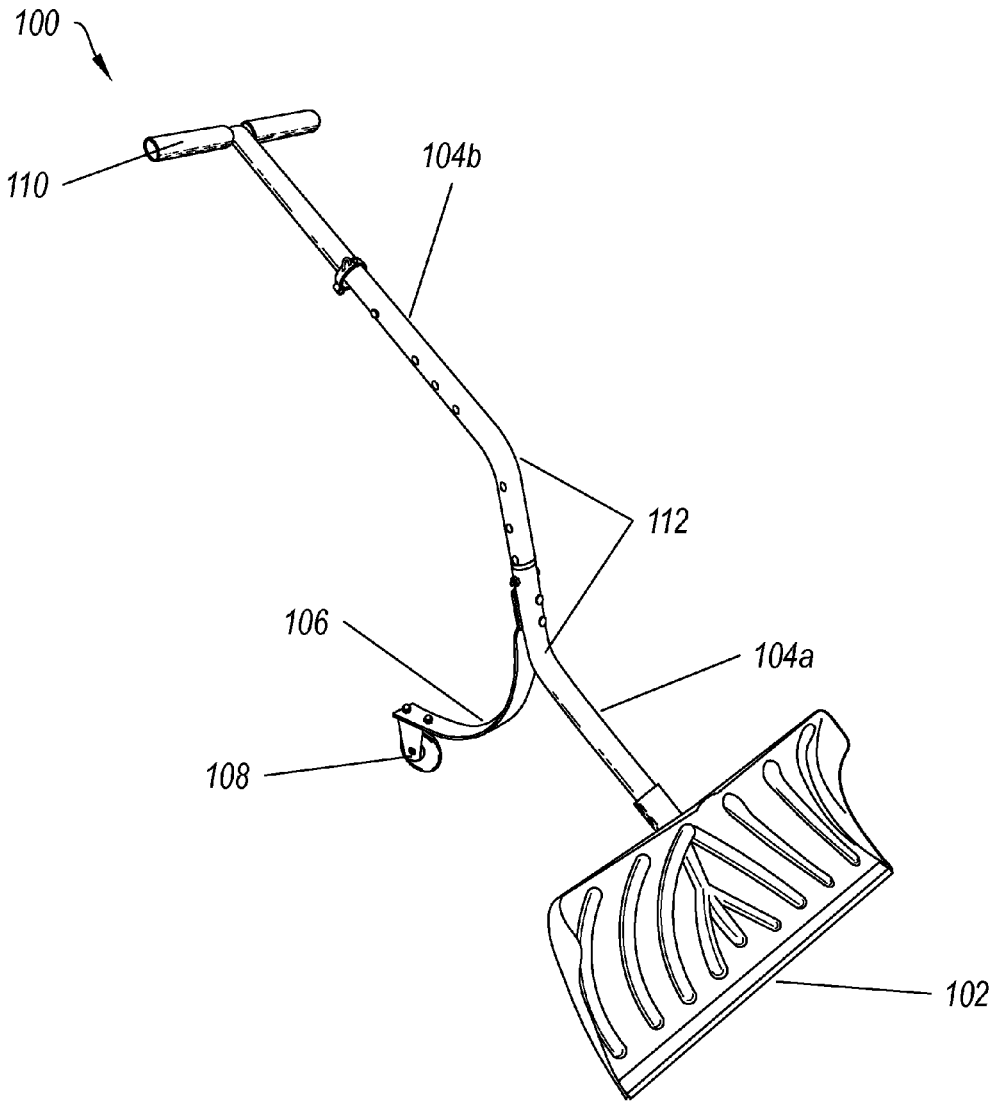
FIG. 1A illustrates a front perspective view of the example of a snow flipper.
Figure 1B:
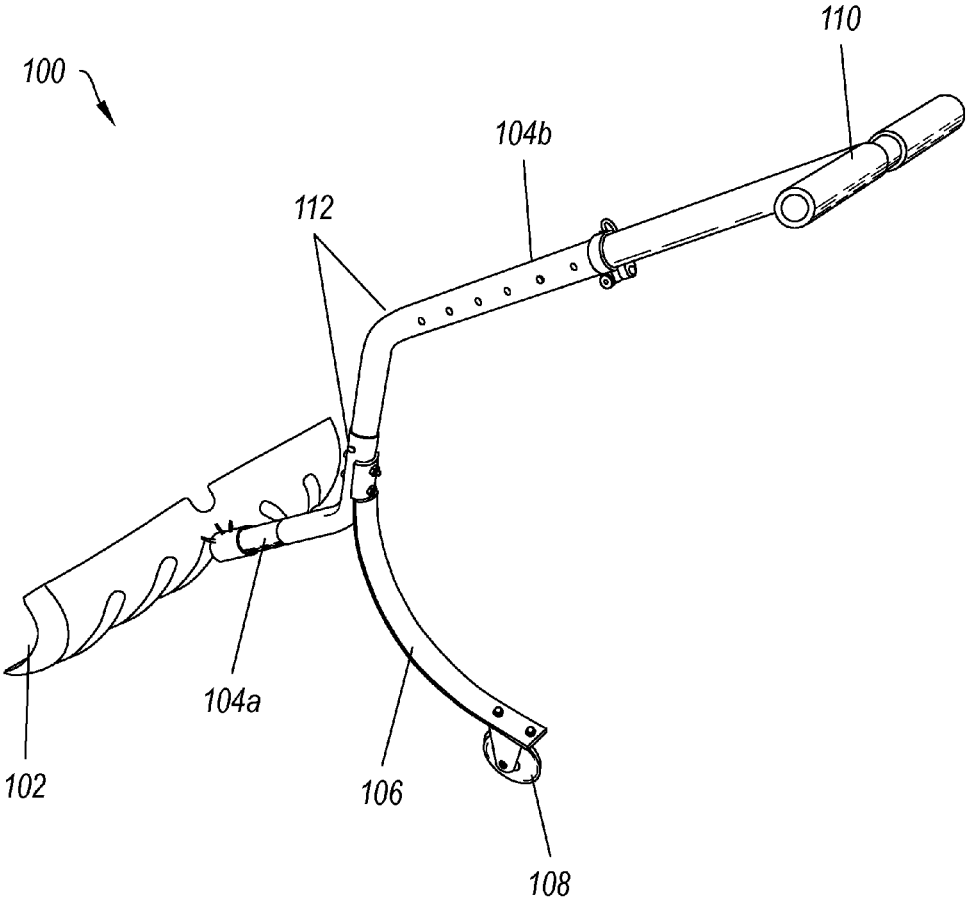
FIG. 1B illustrates a rear perspective view of the example of a snow flipper.
Figure 1C:
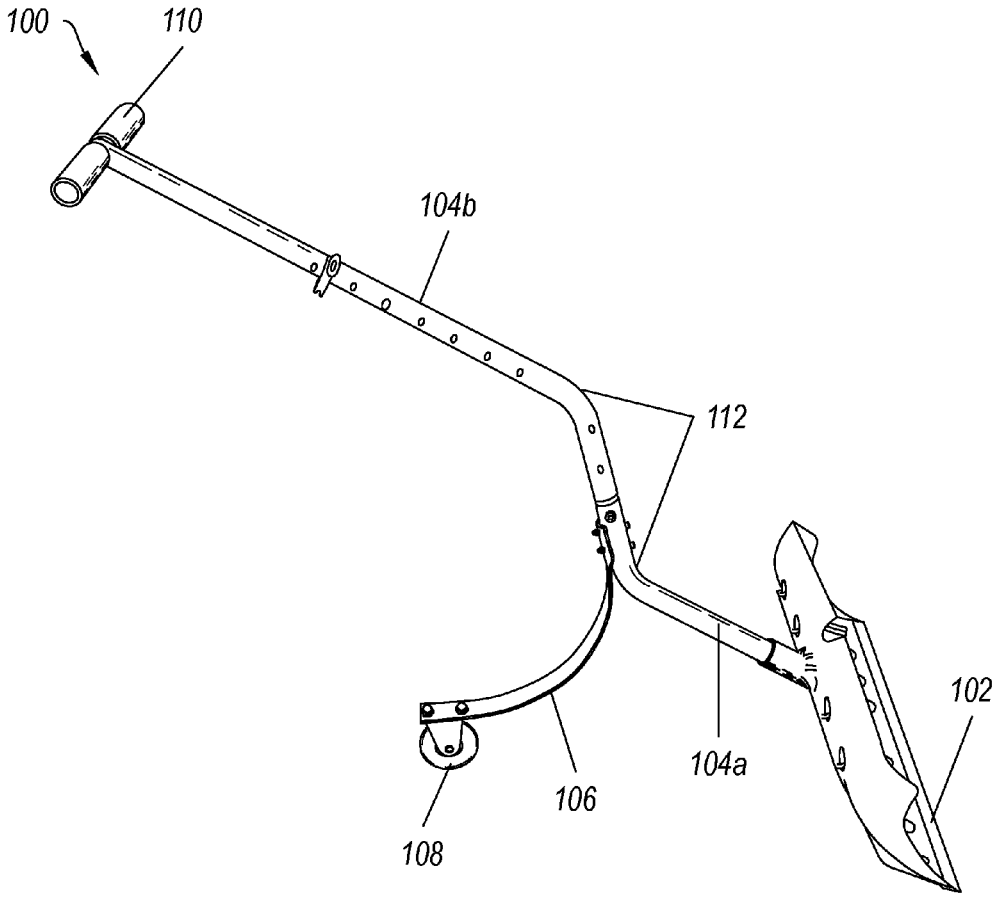
FIG. 1C illustrates a side view of the example of a snow flipper.

FIGS. 1A, 1B and 1C (collectively "FIG. 1") illustrate an example of a snow flipper 100. FIG. 1A illustrates a front perspective view of the example of a snow flipper 100; FIG. 1B illustrates a rear perspective view of the example of a snow flipper 100; and FIG. 1C illustrates a side view of the example of a snow flipper 100. The snow flipper 100 allows a user to move snow without lifting the snow. That is, the snow flipper 100 provides a mechanical advantage that allows a user to clear an area of snow without lifting said snow using the user's back, arms and legs. Instead, the snow flipper 100 uses the movement of the user to propel the snow through the air.

FIG. 1 shows that the snow flipper 100 can include a blade 102. The blade 102 is the portion of the snow flipper 102 that scoops the snow. That is, the blade 102 includes a leading edge which is configured to push under the snow so that the snow can be removed. The blade 102 may be curved toward the handle to allow the snow to better rest within the blade 102 during the removal phase. Likewise, the blade 102 may include a side configured to retain the snow during snow removal.

As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. As a result, the phrase "configured to" reaches well beyond merely describing functional language or intended use since the phrase actively recites an actual state of configuration.

FIG. 1 also shows that the snow flipper 102 can include a lower handle 104*a* and an upper handle 104*a* (collectively "handle 104"). The handle 104 is connected to the blade 102. The handle 104 acts as a lever transferring the motion of the user into motion of the blade 102. In particular, if the handle 104 is moved in the proper manner (described below) it moves the blade 102 at a high enough rate of speed that the snow is forcefully ejected from the blade 102. One of skill in the art will appreciate that the handle 104 can be made of any material of sufficient strength to support the forces which result in the ejection of the snow from the blade 102.

FIG. 1 further shows that the upper handle 104*b* is connected to the lower handle 104*a*. Separating the lower handle 104*a* and the upper handle 104*b* can allow for easier shipping and portability. In particular, it can allow the snow flipper 100 to be broken down into parts which allow for more compact packing and reduced shipping cost. Further, in the case of a mechanical failure the portion of the handle 104 which breaks can be replaced while other portions are retained, reducing the cost of repair.

FIG. 1 additionally shows that the snow flipper 100 can include a flat spring 106. The flat spring 106 is a spring made of a flat or conical shaped piece of metal that returns to its initial configuration when an applied force is removed. That is, when a force is applied the flat spring 106 stores kinetic energy as potential energy, releasing the potential energy as kinetic energy when the force is removed and/or takes a force applied and translates that into motion at the other end of the spring. In the snow flipper 100 the flat spring stores a downward thrust from the user and transforms that into a sharp upward and outward thrust of the blade 102 which forcefully ejects any snow or other objects on the blade 102. The flat spring 106 may be removable to aid in shipping. That is, if the flat spring 106 can be removed then the snow flipper 100 can be packed more compactly reducing shipping expense.

FIG. 1 moreover shows that the snow flipper 100 can include a wheel 108. The wheel 102 aids in movement of the snow flipper 100. In particular, the wheel at least partially supports the weight of the snow flipper 100 and any snow placed thereon. Additionally, the wheel 108 allows for greater maneuverability as it provides a pivot point about which the snow flipper 100 may turn. Finally, the wheel 108 prevents damage to the underlying surface. In particular, the wheel 108 can be made of rubber or any other elastic material. Thus, when the snow flipper 100 leaves the ground because of the rebound of the flat spring 106 the rubber prevents any impact or gouging damage from the flat spring 106 as it regains contact with the underlying surface. Further, the wheel should be non-castering (i.e., it cannot rotate relative to the flat spring 106) to prevent lateral motion of the snow flipper 100 when the user applies a downward force.

FIG. 1 also shows that the snow flipper 100 can include a handgrip 110. The handgrip 110 provides a gripping surface for the user. The handgrip 110 is movably secured to the handle 104. That is, the position of the handgrip 110 relative to the handle 104 can be adjusted. This allows for usage by users of different sizes which is critical because it allows users to exert a downward force (the more the force is straight down the more effective the ejection of snow from the snow flipper). For example, the handgrip 110 can telescope relative to the handle 104 and include a spring loaded clip (i.e., a number of holes within the handle 104 such that a spring loaded post is pushed into one of the holes, securing the handgrip 110 relative to the handle 104. Moreover, the handgrip 110 allows a user to apply a downward thrust which is translated into motion of the blade 102. I.e., the handgrip includes a surface with sufficient friction to prevent the hands of the user from slipping off the snow flipper 100.

FIG. 1 also shows that the handle 104 can include one or more bends 112. The one or more bends 112 allow for the angle of the handle 104 near the user to be in a comfortable position, while allowing the direction of the snow ejection to be controlled. I.e., by having one or more bends 112 the handle 104 can include a vertical or nearly vertical portion, which allows the ejection of the snow to occur in the desired direction. However, near the handgrip 110 the handle 104 allows for ease of control by the user and near the blade 102 the handle 102 is configured to hold the blade 102 at an angle that allows for scooping and "throwing" of the snow.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A snow flipper for clearing snow, the snow flipper comprising:

a blade, wherein the blade:

includes a leading edge configured to push under snow;

a curved portion configured to scoop the snow; and sides configured to prevent movement of the snow laterally relative to the blade;

a handle attached the blade, wherein the handle includes:

a first portion;

a second portion attached to the second portion; and a bend creating a vertical portion of the handle;

a handgrip, wherein the handgrip:

is movably secured to the handle;

telescopes relative to the handle to create different heights; and provides a gripping surface for the user;

a flat spring attached to the vertical portion of the handle, wherein the flat spring includes a curved piece of rigid material configured to:

deform under a force;

return to its initial shape upon removal of the force; and cause downward motion of the handgrip to result in motion that is upward and away from the user; and a wheel attached near one end of the flat spring, wherein the wheel is:

non-castering;

made of rubber; and configured to:

support the end of the flat spring away from the underlying surface; and support at least a portion of the weight of the snow flipper and any snow on the blade.

* * * * *